US005320003A

United States Patent [19]

Ely et al.

[11] Patent Number: 5,320,003

[45] Date of Patent: Jun. 14, 1994

[54] WRENCH FOR UNDERGROUND VALVES

[75] Inventors: Timothy B. Ely; Frederick P. Finck, both of Fairfield; George Shimko, Norwalk, all of Conn.

[73] Assignee: The Highfield Mfg. Company, Bridgeport, Conn.

[21] Appl. No.: 47,855

[22] Filed: Apr. 15, 1993

[51] Int. Cl.[5] ..... B25B 29/00

[52] U.S. Cl. ..... 81/57.4; 81/462

[58] Field of Search ..... 81/52, 57.24, 57.31, 81/57.4, 462

[56] References Cited

U.S. PATENT DOCUMENTS

| | | | |
|---|---|---|---|
| 2,408,450 | 10/1946 | Schrader | 81/462 X |
| 2,721,589 | 10/1955 | Hammer | 81/462 |
| 5,123,308 | 6/1992 | Shaffer | 81/57.31 |

*Primary Examiner*—James G. Smith

*Attorney, Agent, or Firm*—Lorusso & Loud

[57] ABSTRACT

There is presented a device for operating a valve handle in an underground location spaced from a ground surface, the device having brace means for preventing rotation of a housing portion thereof during operation of a turning portion thereof. The brace means includes two body portions, each substantially flat on an upper surface thereof and adapted to receive a foot of an operator so as to bring the weight of the operator to bear on the brace means which engage the ground surface.

8 Claims, 1 Drawing Sheet

WRENCH FOR UNDERGROUND VALVES

BACKGROUND OF THE INVENTION (1) Field of the Invention

This invention relates to wrenches and is directed more particularly to a wrench for turning handles of valves located underground, as in water or gas lines.

(2) Description of the Prior Art

Valves disposed underground often are left unattended for years at a time and become difficult to open or close when the need arises. Because of the location, often at the bottom of a hole dug to gain access to the valve, it is difficult to bring leverage to bear on the valve handle. U.S. Pat. No. 1,626,719, issued May 3, 1927, to Claud Callison, illustrates the use of a gear box in a wrench. The effectiveness of such torque wrenches may be further increased by the use of a power means to supply the input of with a valve handle engaging socket disposed on the free end of the shank portion of the T-shaped bar. The shank is long enough to permit the socket to be positioned on the valve handle while positioning the bar handle at an appropriate height for manual manipulation. Further, it is known to aid the exercise by having in the valve turning tool a gear box which increases the torque applied to the valve handle. U.S. Pat. No. 1,626,719, issued May 3, 1927, to Claud Callison, illustrates the use of a gear box in a wrench. The effectiveness of such torque wrenches may be further increased by the use of a power means to supply the input of the torque gear box, as illustrated in U.S. Pat. No. 4,885,962, issued Dec. 12, 1989 to Ronald L. Summers.

Such wrenches usually do not have means for holding the gear box securely in a stationary position while the wrench handle is turned. It is known to provide torquing lug wrenches for loosening and tightening automotive wheel nuts, with means to prevent rotation of the tool. Such provision is shown in U.S. Pat. No. 3,992,964, issued Nov. 23, 1976, to M. Wayne Osmond, and in U.S. Pat. No. 5,125,297, issued Jun. 30, 1992, to Dawn Bai, et al. Such devices comprise an arm extending radially from the wrench and adapted to engage the ground adjacent the affected wheel to prevent rotation of the tool. Such devices are inappropriate for the wrenches of the type used for underground valves.

Another problem encountered in the use of wrenches for underground valves results from the fact that the terrain above the valve may not be level, making it difficult to manually restrain the gear box while at the same time turning the handle of the tool.

SUMMARY OF THE INVENTION

Accordingly, an object of the present invention is to provide a device for operating a valve handle in an underground location, the device having brace means for preventing rotation of a valve torque multiplier portion of the device during operation of the device.

A further object of the invention is to provide such a device in which the brace means includes two body portions which are substantially flat on an upper surface thereof and adapted each to receive a foot of an operator so as to bring the weight of the operator to bear on the brace means.

A still further object of the invention is to provide a device for operating a valve handle in an underground location, the device having brace means which include two leg portions on opposite sides of the device, the leg portions being individually selectively vertically movable so as to be individually positionable to accommodate different levels of ground surface relative to the level of the torque multiplier portion of the device.

With the above and other objects in view, as will hereinafter appear, a feature of the present invention is the provision of a device for operating a valve handle in an underground location spaced from a generally horizontal ground surface, the device comprising a first shank, a valve handle engagement member fixed to a first end of the first shank, a housing adapted for attachment to a second end of the first shank, a torque multiplier means disposed in the housing and adapted to be in mechanical communication with the first shank, brace means comprising first and second members on opposite sides of the housing and connected to the housing and adapted to engage the ground surface to support the housing in a non-rotatable fashion on the surface, a second shank, the housing being adapted to receive a first end of the second shank so as to place the second shank in mechanical communication with the torque multiplier means, turning means at a second end of the second shank, whereby operation of the turning means causes turning of the second shank and, through the torque multiplier, turning of the first shank and the valve engagement member, and thereby the valve handle.

In accordance with a further feature of the invention, there is provided such a device wherein each of the brace members includes a substantially flat body portion, a first surface of the flat body portion being adapted to engage the ground surface and a second surface of the flat body portion being adapted to receive a foot of an operator, such that the first and second brace members are adapted to support the operator standing thereon, to force the brace members first surfaces into the ground surface to anchor the housing.

In accordance with a still further feature of the invention, there is provided such a device in which each of the brace members includes a foot portion adapted to engage the ground surface and a vertically movable portion fixed to the foot portion and independently and selectively movable relative to the housing to selectively position each of the foot portions on portions of the ground surface at different vertical distances from the level of the housing.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
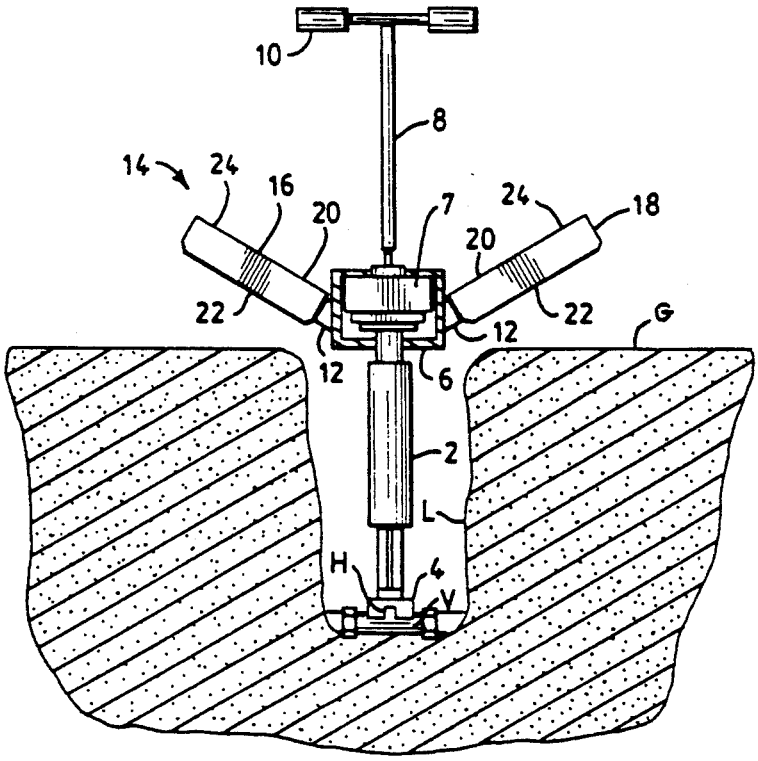
FIG. 1 is an elevational, partly sectional, view of one form of device illustrative of an embodiment of the invention.

Referring to FIG. 1, it will be seen that an illustrative embodiment of the invention includes a first, or lower, shank 2 adapted to have fixed thereto, at a first, or lower, end thereof, a valve handle engagement member, or socket, 4 which is adapted to engage a handle H of an underground valve V. A torque multiplier housing 6 adapted to be fixed to a second, or upper, end of the first shank 2. In the housing 6, there is disposed a torque multiplier means 7 adapted to be in mechanical communication with the first shank 2.

The device further includes a second, or upper, shank 8, a first, or lower, end of which is adapted to be received by the housing 6 and the torque multiplier means 7, such that the upper shank 8 is in mechanical communication with the lower shank 2 through the torque multiplier means 7. At a second, or upper, end of the upper shank 8, there is fixed to the upper shank a turning means 10, which may be, as illustrated, a T-bar to facilitate turning of the upper shank. Alternative turning means include hand wheels and power drive means (not shown).

Thus, operation of the turning means 10 causes rotation of the lower shank 2, with the torque exercised by the lower shank 2 well in excess of that experienced by the upper shank 8, because of the effects of the torque multiplier means 7, which are known in the art.

Attached to the device, as by pivotal fixtures 12 on the housing 6, are brace means 14, comprising first and second brace members 16, 18 on opposite sides of the housing 6. Each of the brace members includes a flat body portion 20. A first, or lower, surface 22 of the flat body portion 20 is adapted to engage a ground surface G proximate a hole L exposing the valve V. A second, or upper, surface 24 of the flat body portion 20 is adapted to receive a foot of an operator (not shown), such that the first and second brace members 16, 18 are adapted to support the operator standing thereon to force the brace members lower surfaces 22 into firm engagement with the ground surface G to anchor the housing 6.

The brace members 16, 18 are pivotally movable from an extended position, generally radial of the housing 6, to a position alongside the housing 6 and substantially parallel to the upper shank 8.

Figure 2:
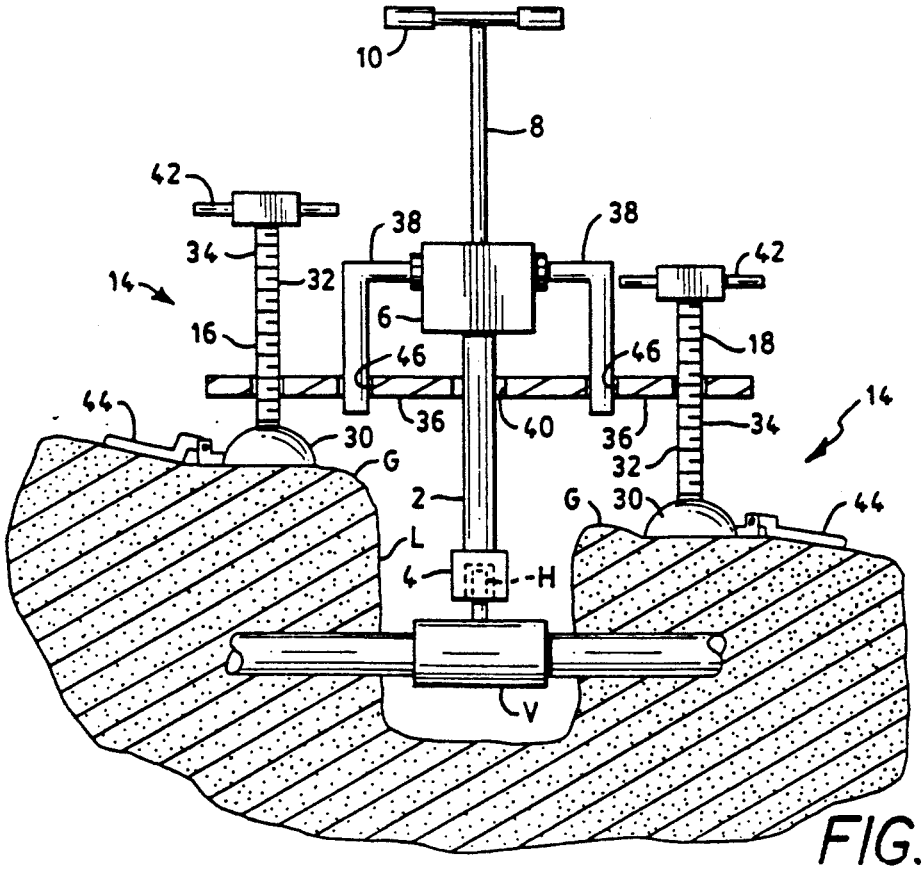
FIG. 2 is an elevational, partly sectional, view of another form of device illustrative of an alternative embodiment of the invention.

Referring to FIG. 2, it will be seen that the brace members may comprise foot portions 30 adapted to engage the ground surface G. Each of the foot portions 30 is fixed to a vertically movable portion 32, which may be in the form of a threaded shank 34. Each of the shanks 34 is threadedly engaged with a base member 36, which may be a substantially horizontal plate, movably connected to the housing 6, as by struts 38. The base member 36 is provided with a central opening 40 through which extends the lower shank 2, and additional openings 46 through which extend portions of the struts 38.

Thus, in the embodiment shown in FIG. 2, handles, or other turning means 42, fixed to the shanks 34, may be operated to raise or lower the foot portions to accommodate different levels of the ground G. The foot portions 30 may be disposed at different distances from the housing 6, but operative to hold the housing against rotation and at a level attitude.

Foot plates 44 may be pivotally attached to the brace members 16, 18 and adapted to receive the feet of an operator to stabilize the housing 6.

In operation of the embodiment shown in FIG. 1, the hole L is dug so as to expose the valve handle H. The lower shank 2, with the valve handle engagement member 4 attached thereto, is engaged with the torque multiplier means 7. The valve handle engagement member 4 is placed over the valve handle H. The upper shank 8 is then engaged with the torque multiplier means 7, placing the upper shank in mechanical communication with the lower shank, through the torque multiplier means. The brace members 16, 18 are pivotally moved to a position in which the lower surfaces thereof 22 engage the ground surface G. The operator then places a foot on each of the brace member upper surfaces 24 and turns the T-bar, or other turning means 10. The torque applied to the T-bar is increased by the torque multiplier and passed to the lower shank 2 and to the valve handle H.

In operation of the embodiment shown in FIG. 2, after the valve handle is exposed, the lower shank 2, with the valve handle engagement member 4 attached thereto, is engaged with the valve handle H. The base member 36 is laid over the shank 2, the shank 2 sliding through the opening 40 in the base member. The housing 6, with the struts 38 fixed thereto, is mounted on the lower shank 2, with the struts 38 passing through the openings 46 in the base member 36. The handles 42 are then turned to adjust the respective heights of the foot portions 30, to complement the terrain around the hole L. Optionally, the embodiment shown in FIG. 2 may be provided with the foot plates 44 which may be pivotally moved to engage the ground surface G and adapted each to receive the foot of an operator. If the difference in heights between the foot portions 30 is extreme, it may require two operators to apply weight to the foot plates 44.

It is to be understood that the present invention is by no means limited to the particular constructions herein disclosed and/or shown in the drawings, but also comprises any modifications or equivalents within the scope of the claims.

Having thus described our invention, what we claim as new and desire to secure by Letters Patent of the United States is:

1. A device for operating a valve handle in an underground location spaced from a ground surface, said device comprising a first shank, a valve handle engagement member fixed to a first end of said first shank, a housing adapted for attachment to a second end of said first shank, a torque multiplier means disposed in said housing and adapted to be in mechanical communication with said first shank, brace means comprising first and second brace members on opposite sides of said housing and connected to said housing and adapted to engage said ground surface to support said housing in non-rotatable fashion on said ground surface, a second shank, said housing being adapted to receive a first end of said second shank so as to place said second shank in mechanical communication with said torque multiplier means, turning means at a second end of said second shank, whereby operation of said turning means causes turning of said second shank and, through said torque multiplier means, turning of said first shank and said valve engagement member, and thereby said valve handle, wherein each of said brace members includes a substantially flat body portion, a first surface of said flat body portion being adapted to engage said ground surface and a second surface of said flat body portion being adapted to receive a foot of an operator, such that said first and second brace members are adapted to support said operator standing thereon, to urge said brace members first surfaces into engagement with said ground surface to anchor said housing.

2. The device in accordance with claim 1, wherein each of said brace members is pivotally mounted on said housing.

3. The device in accordance with claim 1, wherein each of said brace members is independently and selectively vertically movable relative to said housing and said brace members are adapted to be fixed in positions differing in vertical distance from said housing.

4. The device in accordance with claim 1, wherein each of said brace members includes a foot portion adapted to engage said ground surface and a vertically movable portion fixed to said foot portion and independently and selectively movable relative to said housing to selectively position each of said foot portions on portions of said ground surface at different vertical distances from the level of said housing.

5. The device in accordance with claim 4, wherein said vertically movable portions of said brace members comprise threaded shanks threadedly engaged with a substantially horizontal plate, said plate being connected to said housing so as to prohibit relative rotational movement between said housing and said plate.

6. A device for operating a valve handle in an underground location spaced from a ground surface, said device comprising a first shank, a valve handle engagement member fixed to a first end of said first shank, a housing adapted for attachment to a second end of said first shank, a torque multiplier means disposed in said housing and adapted to be in mechanical communication with said first shank, brace means comprising first and second brace members on opposite sides of said housing and connected to said housing and adapted to engage said ground surface to support said housing in non-rotatable fashion on said ground surface, a second shank, said housing being adapted to receive a first end of said second shank so as to place said second shank in mechanical communication with said torque multiplier means, turning means at a second end of said second shank, whereby operation of said turning means causes turning of said second shank and, through said torque multiplier means, turning of said first shank and said valve engagement member, and thereby said valve handle, each of said brace members including a foot portion adapted to engage said ground surface and a vertically movable portion fixed to said foot portion and independently and selectively movable relative to said housing to selectively position each of said foot portions on portions of said ground surface at different vertical distances from the level of said housing, said vertically movable portions of said brace members comprising threaded shanks threadedly engaged with a substantially horizontal plate, said plate being connected to said housing so as to prohibit relative rotational movement between said housing and said plate, wherein one of said foot portions includes a substantially flat body portion adapted to receive a foot of an operator, such that said operator may stand on said foot portion to force said foot portion into said ground surface to anchor said plate and thereby said housing.

7. The device in accordance with claim 6, wherein said foot portion is pivotally fixed to one of said brace members.

8. A device for operating a valve handle in an underground location spaced from a ground surface, said device comprising shank means, a valve handle engagement member fixed to one end of said shank means, turning means fixed to the other end of said shank means, a housing disposed on said shank means between said one end and said other end thereof, first and second brace members on opposite sides of said housing and connected to said housing and adapted to engage said ground surface to support said housing in non-rotatable fashion on said ground surface, whereby operation of said turning means causes turning of said shank means and said valve engagement member, and thereby said valve handle, each of said brace members including a substantially flat body portion, a first surface of said flat body portion being adapted to engage said ground surface and a second surface of said flat body portion being adapted to receive a foot of an operator, such that said first and second brace member are adapted to support said operator standing thereon, to urge said brace members first surfaces into engagement with said ground surface to anchor said housing.

* * * * *

UNITED STATES PATENT AND TRADEMARK OFFICE
CERTIFICATE OF CORRECTION

PATENT NO. : 5,320,003

DATED : June 14, 1994

INVENTOR(S) : Ely, T., et al.

It is certified that error appears in the above-identified patent and that said Letters Patent is hereby corrected as shown below:

Col.1, line 15 after "handle." begin a new paragraph, delete "U.S. Pat. No. 1,626,719 issued May 3, 1927 to Claud Callison, illustrates the use of a gear box in a wrench. The effectiveness of such torque wrenches may be further increased by the use of a power means to supply the input of" and insert --It is known in such circumstances to use T-shaped bars--;

Col. 3, line 13 before "adapted" insert --is--; and

Col. 6, line 43 after "brace" delete "member" and insert --members--.

Signed and Sealed this

Twentieth Day of September, 1994

*Attest:*

Bruce Lehman

BRUCE LEHMAN

*Attesting Officer*

*Commissioner of Patents and Trademarks*